US005673869A

United States Patent [19]

Honegger

[11] Patent Number: 5,673,869

[45] Date of Patent: Oct. 7, 1997

[54] MOUNT FOR A WINDING UNIT AND APPARATUS FOR PROCESSING PRINTED PRODUCTS

[75] Inventor: Werner Honegger, Bäch, Switzerland

[73] Assignee: Ferag AG, Hinwil, Switzerland

[21] Appl. No.: 583,136

[22] Filed: Dec. 28, 1995

[30] Foreign Application Priority Data

Dec. 30, 1994 [CH] Switzerland ..... 03969/94

[51] Int. Cl.[6] ..... B65B 63/04; B65H 16/04; B65H 18/10

[52] U.S. Cl. ..... 242/528; 242/533; 242/533.8; 242/541.3; 242/559.4; 242/598.4; 242/564.5

[58] Field of Search ..... 242/528, 533, 242/533.8, 559.4, 598.4, 564.5, 541.3; 53/118, 119

[56] References Cited

U.S. PATENT DOCUMENTS

| | | | |
|---|---|---|---|
| 4,508,523 | 4/1985 | Leu . | |
| 4,587,790 | 5/1986 | Müller . | |
| 4,676,496 | 6/1987 | Honegger . | |
| 4,768,768 | 9/1988 | Reist . | |
| 4,854,806 | 8/1989 | Gertsch et al. . | |
| 4,898,336 | 2/1990 | Reist | 242/528 |
| 4,901,935 | 2/1990 | Reist . | |
| 4,928,899 | 5/1990 | Reist . | |
| 4,995,563 | 2/1991 | Kalin | 242/528 |
| 5,158,242 | 10/1992 | Honegger . | |
| 5,176,333 | 1/1993 | Stauber | 242/528 |

FOREIGN PATENT DOCUMENTS

| | | |
|---|---|---|
| 243 837 | 11/1987 | European Pat. Off. . |
| 2 596 030 | 9/1987 | France . |
| 22 09 911 | 9/1973 | Germany . |
| 652 699 | 11/1985 | Switzerland . |
| 339844 | 12/1930 | United Kingdom . |
| 2 229 168 | 9/1990 | United Kingdom . |
| WO94/12421 | 6/1994 | WIPO . |

*Primary Examiner*—John M. Jillions
*Attorney, Agent, or Firm*—Bell, Seltzer, Park & Gibson, P.A.

[57] ABSTRACT

A mount for rotatably supporting a winding unit which comprises printed products which are wound upon a core and which has a winding band which is connected to the core of the unit and wound with the products. The mount includes a bearing arrangement for rotatably supporting the winding unit and which is elevationally displaceable, and the mount also includes a rest element upon which the winding band rests when the winding unit is lowered. This prevents the winding band from being released and the winding unit from falling apart. The mount can be docked onto an unwinding station, which includes provision for lifting the winding unit off from the rest element so that the printed products can be unwound.

19 Claims, 4 Drawing Sheets

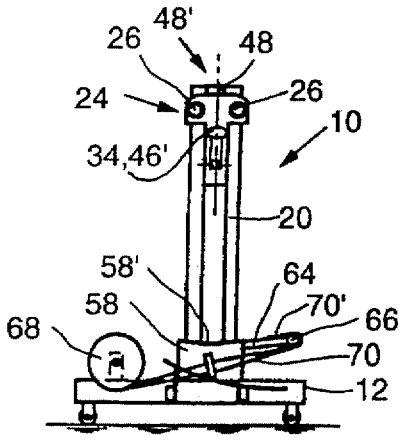
Fig.4
Fig.7
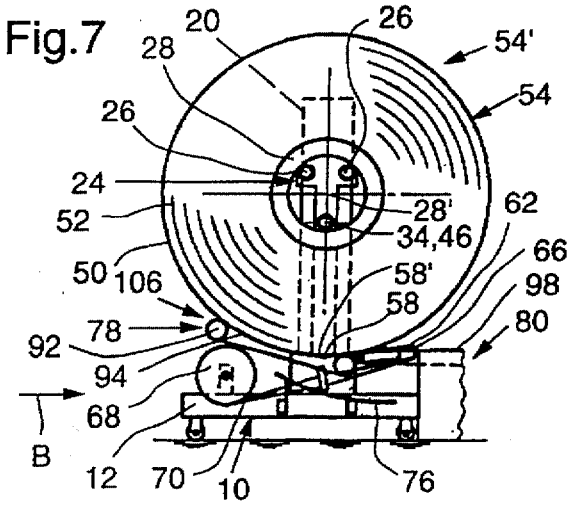
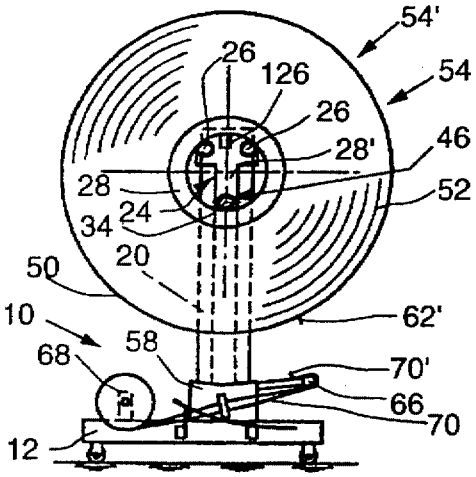
Fig.5
Fig.8
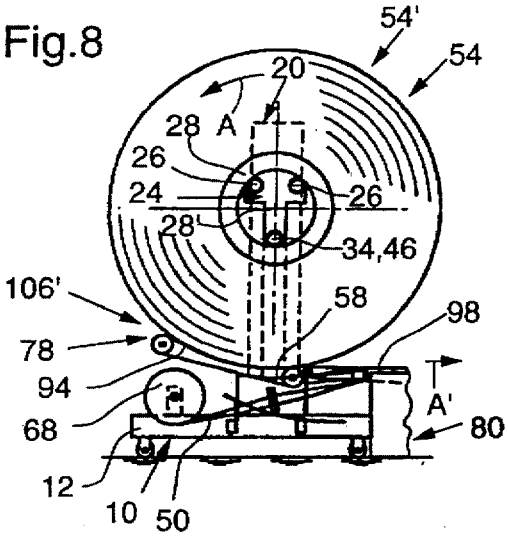
Fig.6
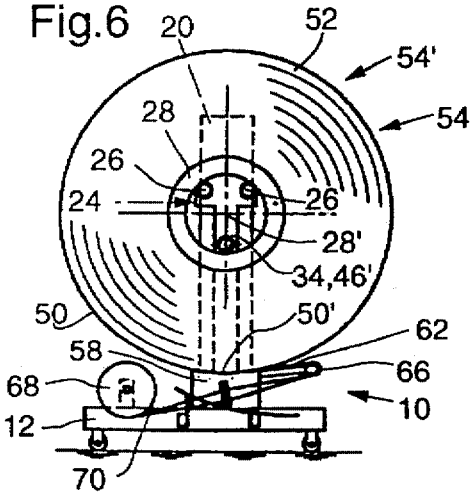
Fig.9
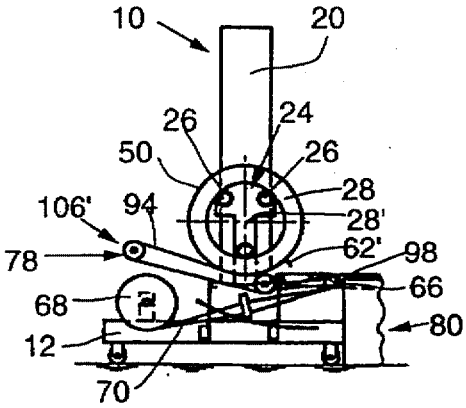

MOUNT FOR A WINDING UNIT AND APPARATUS FOR PROCESSING PRINTED PRODUCTS

FIELD OF THE INVENTION

The present invention relates to a mount for a winding unit and to an apparatus for processing flexible sheet-like arrangements such as printed products, including newspapers, periodicals or the like.

BACKGROUND OF THE INVENTION

A mount for a winding unit and an apparatus for processing flexible sheet-like arrangements of this type are disclosed in EP-A-0 243 837 and the corresponding U.S. Pat. Nos. 4,768,768 and 4,928,899. The mount includes a transportable framework on which there is fixedly arranged a bearing arrangement for mounting a winding core which can be rotated about the horizontal axis thereof. A winding band is connected, at one end, to the winding core and, at the other end, to a band reel mounted in the framework so that it can be removed therefrom. If a winding unit, i.e. a winding core with printed products wound up thereon, together with the winding band under tensile stressing, to form a roll, is arranged on the bearing arrangement during transportation of the mount or in interim storage for the printed products, loosening of the winding band has to be prevented. Otherwise, there is a danger of the roll falling apart. Consequently, means, for example socket pins, brakes or the like, for blocking the band reel and the roll are provided on the mount.

In each of the two prior art apparatuses, one of the mobile mounts can be docked onto a stationary winding station. The latter patent includes a rocker which can be advanced up to the roll or up to the empty winding core from beneath and has a conveying-belt arrangement for feeding the printed products to the winding core or to the roll which are to be wound up together with the winding band under tensile stress. The conveying-belt arrangement also is provided for removing the printed products which are unwound from the roll. When the mount has been docked onto the winding station, the rocker is retained by a cylinder/piston assembly in abutment against the winding unit so that it adapts to the different diameter of the winding unit, which is mounted in a stationary manner. Furthermore, the winding station includes a drive arrangement for acting on the circumference of the winding core or on the roll and a drive arrangement which is intended for acting on the band reel. These are each provided with a drive roller designed as a friction wheel and interacts with the winding band.

A further mobile mount for a winding unit and an apparatus for processing printed products is disclosed in CH-A-652 699 and the corresponding U.S. Pat. No. 4,587,790. The mount includes a transportable framework on which a winding core and a band reel are fixed such that they can be rotated. A winding band is connected, at one end, to the winding core and, at the other end, to the band reel. The shaft of the winding core and the winding band or the band reel can be blocked by means of a shoe brake so that the finished roll can be held together by the winding band under tensile stress.

The mount can be docked onto a winding-up station provided with a drive for the winding core and onto an unwinding station provided with a drive for the band reel. When printed products in an imbricated formation are wound up onto the winding core, together with the winding band, the winding core is driven and, in order to keep the winding band under tensile stress, the band reel is braked by the corresponding shoe brake. To unwind the printed products wound up onto the winding core, together with the winding band under tensile stress, to form a roll, the band reel is driven and the winding core is braked by the associated shoe brake. The stationary winding-up and unwinding stations include a belt conveyor designed as a rocker and, by means of a pressing-on mechanism, can be advanced up to the roll or winding core, mounted in a stationary manner on the framework, from beneath, to feed or remove the printed products.

A further mount for a winding unit is known from EP-A-0 149 058 and the corresponding U.S. Pat. No. 4,676,496. It includes a bearing arrangement which is arranged fixedly on a displaceable framework and is intended for mounting a winding unit so that it can be rotated. Furthermore, a belt conveyor designed as a rocker is mounted pivotably on the framework, which conveyor is retained in abutment against the roll from beneath by means of a pneumatic spring. The conveying-belt arrangement and the band reel, which are intended for taking up the winding band when the roll is unwound, are connected to a gear wheel which, when the mount is docked onto a processing line, continuously processes the printed products unwound from the roll which comes into engagement with a drive gear wheel of the processing line. Such prior art mounts are of a complicated design and take up a considerable amount of space. Moreover, they are heavy and are not envisaged for the interim storage of the wind-up printed products.

EP-A-0 292 891 and the corresponding U.S. Pat. No. 4,901,935 disclose an apparatus for unwinding printed products wound up onto a winding core together with a winding band. The unwinding station includes two parallel endless supporting belts which are guided around deflection rollers spaced apart from one another in the horizontal direction. A winding unit, which is transported to the apparatus by means of, for example, a handling vehicle, is deposited on the two supporting belts for rotary mounting purposes. A band reel, on which the free end of the winding band of the winding unit is fastened, and the supporting belts are driven, in order for the printed products to be unwound from the winding unit, by a motor integrated in the apparatus.

SUMMARY OF THE INVENTION

Taking this prior art as the departure point, an object of the present invention is to provide a mount of the generic type which, with a straightforward and space-saving construction, ensures simple, reliable blocking of the winding band and provides an apparatus for processing flexible sheet-like arrangements wherein the blocking of the winding band can be released in an extremely simple manner when a mount is docked onto a stationary winding station.

This object is achieved by a mount and by an apparatus for processing flexible sheet-like arrangements. The mount for a winding unit includes a winding core and a winding band which is fastened at one end to the winding core and is wound up under tensile stress together with the flexible sheet-like arrangements, onto the winding core to form a roll. The mount further includes a mobile framework including a bearing arrangement which is arranged on the framework for mounting the winding core so that it can be rotated about a horizontal axis. The framework also has means for blocking the winding band. The bearing arrangement can be moved at least approximately in the vertical direction wherein a rest element is produced on the framework, beneath the bearing arrangement so that the winding band rests on the rest element. This occurs when the winding unit has been lowered onto the rest element to block the winding band.

An apparatus for processing flexible sheet-like arrangements having plural mounts is also set forth. The apparatus includes at least one stationary winding station onto which one of the plural mounts is docked and which comprises a rocker which, when the mount has been docked, is advanced up to a winding unit from below and has a conveying-belt arrangement for transporting the sheet-like arrangements. The winding station also includes lifting means for lifting the winding unit mounted on the bearing arrangement from a rest element of the framework of the winding unit.

According to the invention, the weight of the winding unit and bearing arrangement are utilized in order to block the winding band. The winding band is held clamped between a bearing element and the roll supported thereon. Separate means for blocking the winding core are not necessary.

According to the invention, a stationary winding station includes the lifting means for lifting the winding unit off from the rest element. This likewise ensures simple construction of the mounts since corresponding lifting means are unnecessary. In the event of plural mounts being used, only one lifting means has to be provided, namely at the winding station.

BRIEF DESCRIPTION OF THE DRAWINGS

The invention will now be described in more detail with reference to an exemplary embodiment represented in the drawing, in which, purely schematically:

FIGS. 4 to 6 are elevational views, reduced in scale with respect to FIGS. 1 and 2, which show a mount at three different points in time during loading with a winding unit; and FIGS. 7 to 9 are elevational views, reduced in scale with respect to FIGS. 1–12 showing the mount docked onto the stationary winding station according to FIG. 3, at three different points in time of the unwinding operation.

DETAILED DESCRIPTION OF THE DRAWINGS

Figure 1:
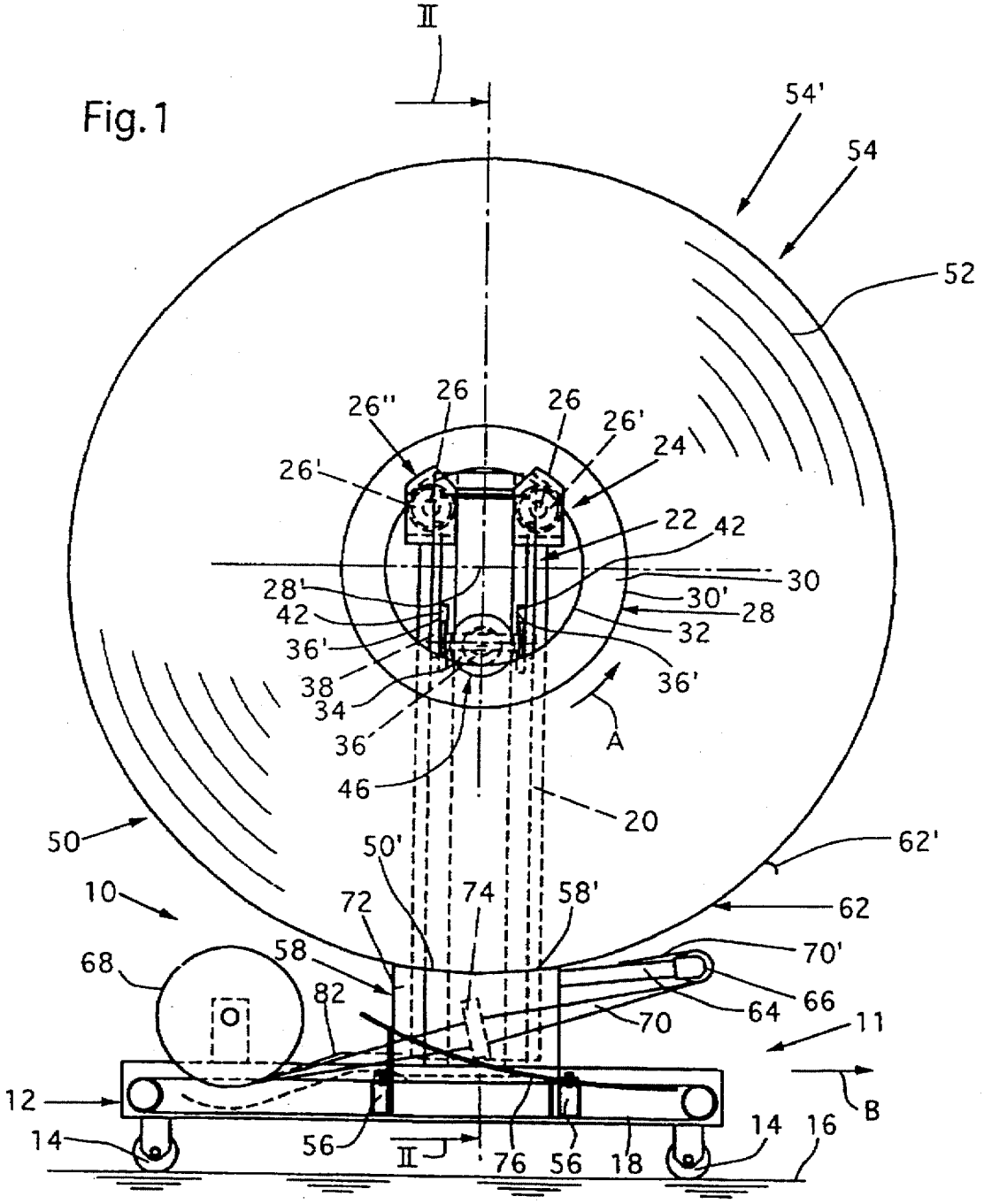
FIG. 1 is an elevational, sectional of a mount according to the invention having a winding unit arranged on its bearing arrangement and deposited on a bearing element.
Figure 2:
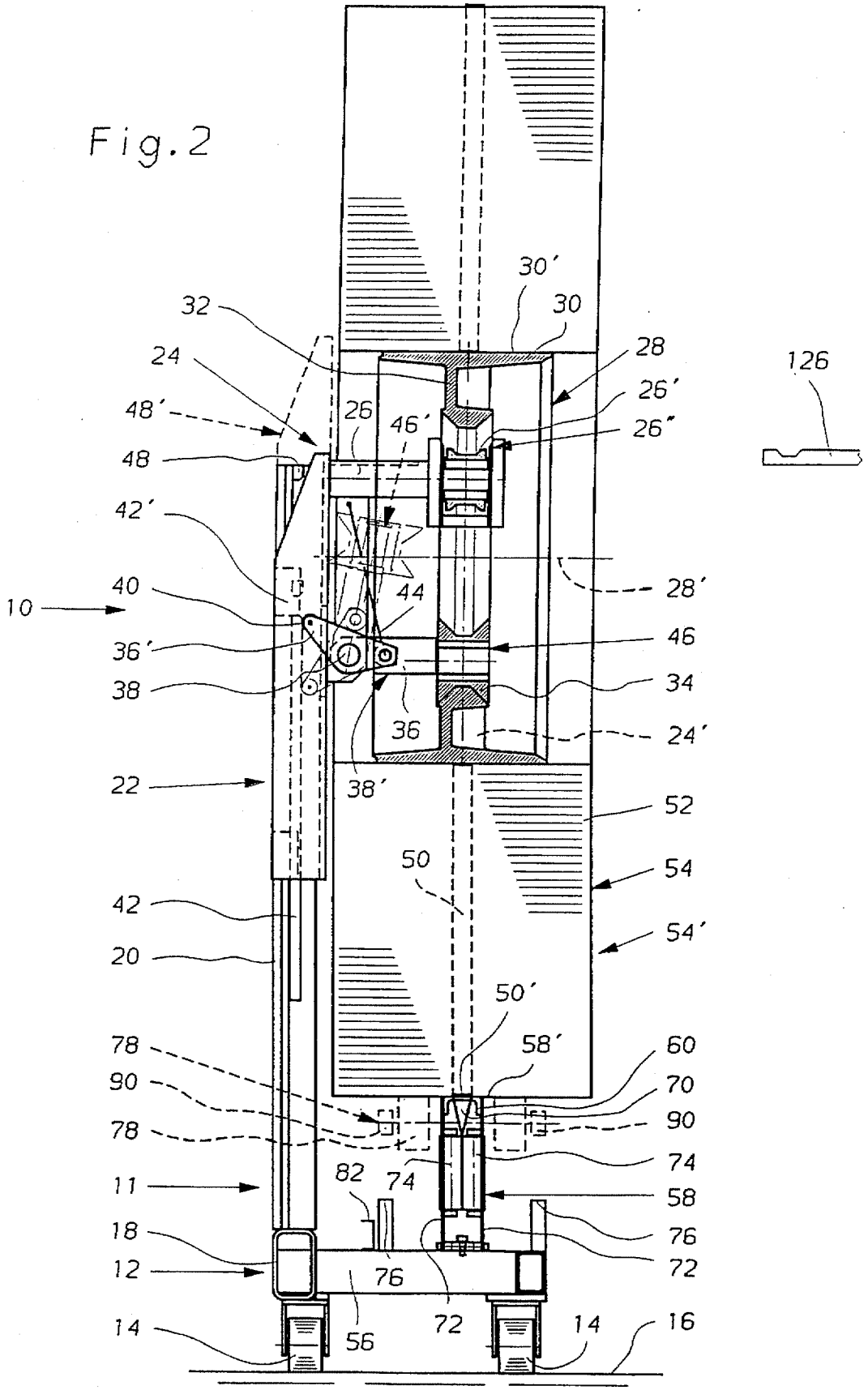
FIG. 2 is a sectional view of the mount of FIG. 1 with the winding unit taken along line II—II of FIG. 1.

A mount 10 shown in FIGS. 1 and 2 comprises a framework 11 with a chassis frame 12 on which castors 14 are arranged in order that the mount 10 can be displaced on the floor 16 or in guides. Of course, the chassis frame 12 may also be supported on the floor 16 by stationary legs. In such case, the mount 10 can be transported, for example, by a fork-lift truck.

Projecting upwards in the vertical direction from a longitudinal crossmember 18 of the chassis frame 12 is a guide rail 20 which is integral with the framework 11 and on which a carriage 22 or trolley of a bearing arrangement 24 is guided in a freely movable manner. Two parallel, spaced-apart supports 26 arranged in a horizontal plane project in the manner of extensions from the carriage 22. Each of the supporting rollers 26' being mounted in a freely rotatable manner at the free ends of the supports 26. The supporting rollers 26' form a bearing member 26" for a hollow-cylindrical winding core 28, the longitudinal axis of which is designated by 28'. The winding core 28 comprises a bearing rib 32 which runs all the way around the core, is arranged at least approximately in the plane of the center of gravity of the core, projects radially inwards from a winding body 30 and the inner end region of which is of a cross-sectionally approximately V-shaped design and interacts with the mating supporting rollers 26.

In the center between the two supporting rollers 26, and therebeneath, a retaining roller 34 formed in the same manner as the supporting rollers 26 interacts with the bearing rib 32, which retaining roller is mounted in a freely rotatable manner at the free end of a first lever arm 36 of a two-armed retaining lever 38' which can be pivoted, on the carriage 22, about a horizontal axis 38. Mounted in a freely rotatable manner at the free end of the other, second lever arm 36' of the retaining lever 38' is a control roller 40, which interacts with a control track 42 arranged on the guide rail 20. As can be seen from FIG. 2, a tension spring 44 acts between the first lever arm 36 and the carriage 22 which tension spring biases the lever arm 36 out of the retaining position 46, which is shown in FIGS. 1 and 2 and in which the retaining roller 34 acts on the winding core 28, in the direction of a rest position 46', in which the retaining roller 34 is lifted off from the bearing rib 32 of the winding core 28. In FIG. 2, the rest position 46' is indicated by chain-dotted lines. The control track 42, running in the vertical direction, comprises in its upper end region, a depression 42' into which the control roller 40 can move out of the way when the carriage 22 is moved into the corresponding position, as a result of which the retaining lever 38' can be pivoted from the retaining position 46 into the rest position 46' under the action of the tension spring 44. At its upper end, the guide rail 20 comprises a latching device 48 which interacts with the carriage 22 for retaining the bearing arrangement 24 releasably in its upper end position, the receiving position 48', in which the retaining lever 38' is pivoted into the rest position 46'.

One end of a winding band 50 is connected to the winding core 28, which winding band, in a known manner, is wound up, under tensile stress and, together with printed products 52, which as arranged in imbricated formation, such as newspapers, periodicals or the like, onto the circular-cylindrical outer surface 30' of the winding body 30 to form a multi-layered roll 54. The winding core 28 with the roll 54 thus forms a winding unit 54' guided on the bearing arrangement 24.

Arranged on transverse crossmembers 56 of the chassis frame 12 is a rest element 58 which is intended for supporting the winding unit 54', which is guided on the bearing arrangement 24 and has been lowered onto the rest surface 58' of the rest element 58, on its circumference, the rest element bearing the weight of said winding unit. The rest surface 58' is formed by the web of a U-profile 60 which is open towards the bottom and extends beneath the bearing arrangement 24 in the bearing plane 24' established by the supporting rollers 26 and the retaining roller 34 located in the retaining position 46. As seen in the direction of the axis 28', the rest surface 58' is approximately double the width of the width of the winding band 50 and, seen in the circumferential direction, extends approximately over a region which corresponds more or less to the diameter of the winding core 28 or is smaller than the latter. The degree of curvature of the rest element 58 corresponds to the radius of the largest roll 54 to be processed or it may comprise sections which adjoin one another in a correspondingly polygonal manner; the rest element 58 shown in FIG. 2 includes two such V-shaped sections.

As can be seen, in particular, from FIG. 2, when a winding unit 54' is deposited on the rest element 58, a section 50' of the winding band is clamped in between the roll 54 and the rest element 58. As seen in the unwinding direction A, the section 50' is followed by an end section 62 of the winding band 50 with the free end 62'. The winding band 50, under tensile stress, engages around the outermost wound layer and, due to the weight of the winding unit 54' and bearing arrangement 24, is clamped fixedly such that it is blocked and cannot be released. Blocking means for the winding core 28 are thus not necessary.

A bar 64 projects in the manner of an extension from the rest element 58, as seen in the unwinding direction A, and a deflection roller 66 is mounted in a freely rotatable manner at the free end of said bar. On that side of the rest element 58 which is remote from said deflection roller 66, a band reel 68 is mounted in a rotatable manner on the chassis frame 12. Fastened on the band reel 68 is one end of a reel band 70 which runs between two wall panels 72 to the deflection roller 66 and is guided around the latter. A free end section 70' of the reel band 70 rests on the bar 64. The wall panels 72 are fastened on the transverse crossmembers 56 and the U-profile 60 is fastened on the upper end region of said panels. Two guide rollers 74, which form a guide nip for the reel band 70, are mounted on the mutually facing sides of the wall panels 72, which guide rollers 74 twist the reel band 70 between the band reel 68 and the deflection roller 66 for lateral guidance.

On both sides of the rest element 58, guide tracks 76 for a rocker 78, indicated by chain-dotted lines in FIG. 2, of a stationary unwinding station 80 are arranged on the chassis frame 12 or the crossmembers 56. Between the guide rail 20 and the guide track 76 which is nearer to the latter, a cross-sectionally C-shaped guide profile 82 is fastened on the transverse crossmembers 56, which guide profile 82 includes a section which runs parallel to the floor 16 and a section which adjoins said first section, as seen counter to a docking direction B, runs obliquely downwards and is guided beneath the band reel 68, as seen in the vertical direction.

Figure 3:
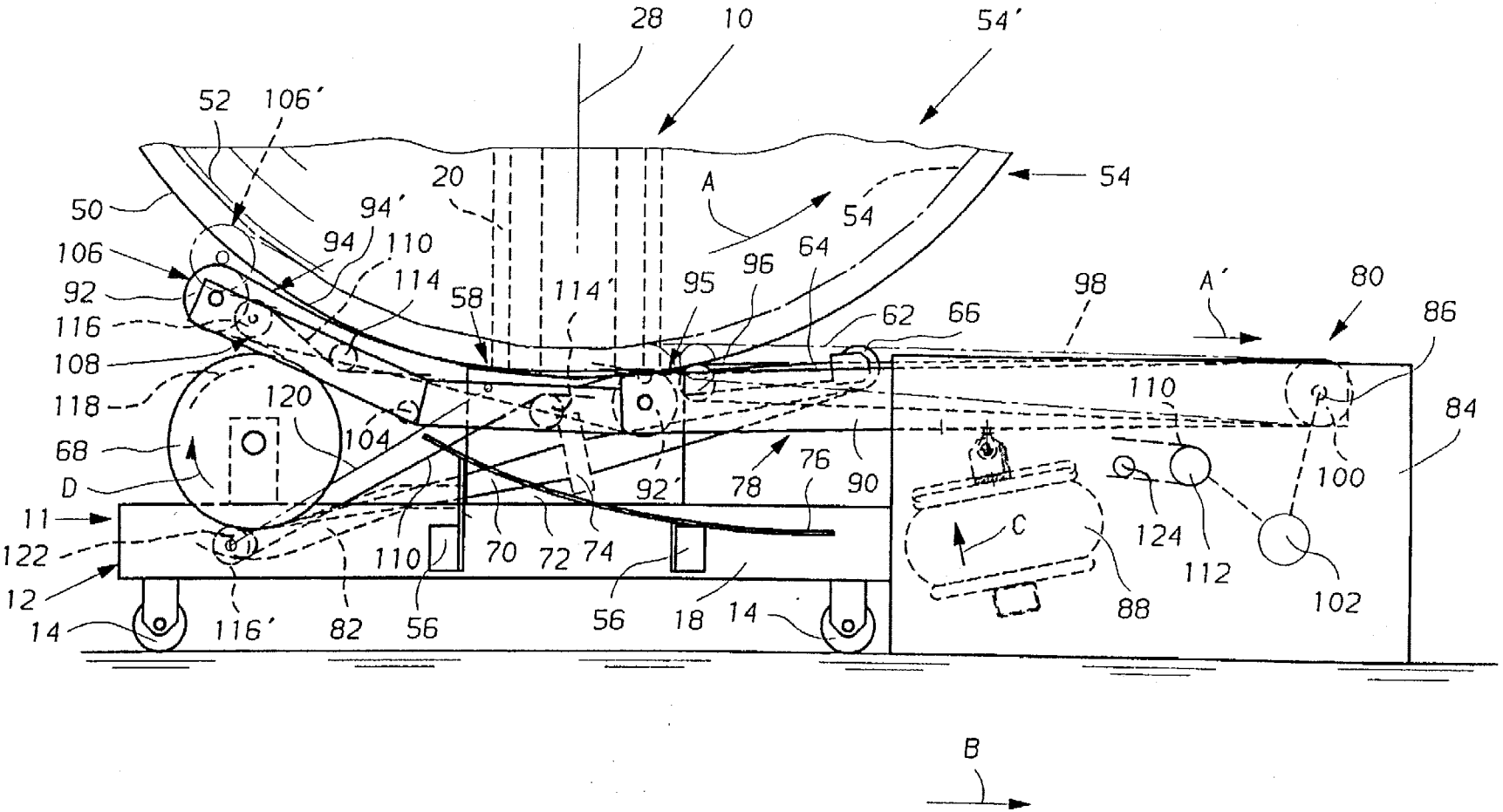
FIG. 3 is an elevational view of part of the mount of FIG. 1 docked onto a stationary winding station.

FIG. 3 shows the mount 10, which has been described above and as shown in FIGS. 1 and 2, docked onto a stationary unwinding station 80 on the end side, in the docking direction B. The same parts of the mount 10 are identified in FIG. 3 by the same references as in FIGS. 1 and 2. They will thus only be further described insofar as is necessary for understanding FIG. 3.

The stationary unwinding station 80 includes a stationary machine framework 84 on which a rocker 78 is mounted such that it can be pivoted about a shaft 86 running in the horizontal direction. Connected to the rocker 78 is one side of a lifting bellows 88, of which the other side is supported on the machine framework 84 and which can be connected to a compressed-air source in order that the rocker 78 can be pivoted upwards in the direction of the arrow C. The rocker 78 is designed in the manner of a fork and includes two supports 90 which project beyond the machine framework 84, counter to the docking direction B, and between which the rest element 58 is located when the mount 10 has been docked onto the unwinding station 80, see also FIG. 2. Deflection wheels 92 are mounted in a freely rotatable manner at the free ends of the supports 90, said deflection wheels being located approximately above the band reel 68. Mounted in a freely rotatable manner on each support 90 is, in each case, a further deflection wheel 92', which, when a mount 10 has been docked, is located between a vertical plane 28", in which the axis 28' of the winding core 28 arranged on the bearing arrangement 24 is located, and the machine framework 84. Wrapped around the deflection wheel 92 and further deflection wheel 92' of each support 90 is an endless, elastic supporting belt 94, of which the upper strand 94', which extends between the two deflection wheels 92 and 92', abuts against the roll 54 with supporting action when the rocker 78 is pivoted in arrow direction C. As can be seen, in particular, from FIG. 2, the supporting belts 94 are not in contact with the winding band 50. The rocker 78 designed in this manner forms a lifting means 95 for the winding unit 54' guided on the bearing arrangement 24.

Adjacent to the further deflection wheel 92', a conveying-belt deflection wheel 96 is mounted in a freely rotatable manner on each support 90, the conveying-belt deflection wheel 96 having an endless conveying belt 98 wrapped around it, which conveying belt 98 is further guided around a drive wheel 100 which is seated in a rotationally fixed manner on the shaft 86. The shaft 86 is connected to a drive motor 102 for driving the conveying belt 98 in the unwinding direction A'. The conveying-belt deflection wheel 96 is connected, for drive operation, to the respective further deflection wheel 92', with the result that, when the printed products 52 are unwound from the roll 54, the conveying belts 98 and the supporting belts 94' are driven in circulation in the direction according to arrow A', this direction being counter to the unwinding direction A.

Furthermore, in each case one guide roller 104 is mounted in a freely rotatable manner on the supports 90, which guide roller 104 is intended for interacting with the corresponding guide tracks 76 when a mount 10 is docked onto the unwinding station 80.

In FIG. 3, solid lines show the rocker 78 in a rest position 106, and the chain-dotted lines show the rocker 78 in an operating position 106', in which it is pivoted upwards with respect to said rest position 106; the position of the roll 54 when the rocker 78 is located in the operating position 106' is also indicated by chain-dotted lines.

As is indicated schematically, the drive motor 102 is connected to a drive arrangement 108 for the band reel 68. The drive arrangement 108 includes an endless drive belt 110 which, guided around a guide roller 114 arranged on the support 90 adjacent to the guide rail 20, runs from a drive roller 112, which is mounted on the machine framework 84 and can be connected to the drive motor 102, to a deflection roller 116 which is mounted in a rotatable manner in the end region of said support 90. The drive belt 110, by its inner side, engages around said deflection roller 116 and then, by its outer side, engages around a reel drive wheel 118, which is connected in a rotationally fixed manner to the band reel 68, and then, by its inner side again, engages around a further deflection roller 116' arranged beneath the reel drive reel 118. From there, the drive belt 110 runs around a further guide roller 114' on the support 90 and back to the drive roller 112.

The drive belt 110 is driven at such a speed that, when the printed products 52 are unwound from the roll 54, the band reel 68 tends to rotate in the winding-up direction D at a circumferential speed which is greater than the speed of the supporting belts 94 and conveying belts 98. Consequently, the winding band 50 connected to the reel band 70 is also retained under tensile stress during unwinding, the drive wheel 110 and the reel drive wheel 118 forming a friction or sliding coupling.

The further deflection roller 116' is arranged at the free end of a lever 120, which is articulated on said support 90. Fastened on the lever 120 is a follow-on member 122, for example a sliding block or a roller, which, in the event of docking, runs into the guide profile 82 and is then guided by the latter in order that the pivot position of the lever 120, which is prestressed into an upper end position, is controlled such that the further deflection roller 116' moves around the bottom of the reel drive wheel 118, and that section of the drive belt 110 which is located between the two deflection rollers 116 and 116' can thus abut against the reel drive wheel 118. The resulting change in the necessary belt length is compensated by a tensioning device 124.

The mode of functioning of the apparatus, shown in FIGS. 1 to 3, for processing printed products will now be described in more detail with reference to FIGS. 4 to 9.

FIG. 4 shows a free-standing mount 10, of which the bearing arrangement 24 is located in the receiving position 48', in which it is retained by the latching device 48. The control roller 40 is located in the depression 42' of the control track 42 (FIG. 2), as a result of which the retaining roller 34 is pivoted into the rest position 46'. The end section 70' of the reel band 70 is located on the bar 64.

By means of a handling device 126, of which only a supporting arm is indicated in FIGS. 1 and 5, a winding unit 54' is placed on the bearing arrangement 24, with the result that the bearing rib 32 comes to abut against the supporting rollers 26. Care should be taken here that the roll 54 assumes the correct position in relation to the unwinding position A. The winding unit 54' is then lowered by means of the handling device 126, the weight of the winding unit 54' meaning that the latching device 48 is released automatically and the latter releases the bearing arrangement 24. However, the latter cannot drop downwards since, on account of the downwards movement of the carriage 22, the retaining roller 34 is pivoted, counter to the force of the tension spring 44, from the rest position 46' in the retaining position 46. It is only once the retaining position 46 has been reached (FIG. 5) that the control roller 40 is moved out of the depression 42', and the bearing arrangement 24 can then be lowered together with the winding unit 54' until the latter rests on the rest element 58. Thereafter, the handling device 126 releases the winding core 28, and the end 62' of the winding band 50 is connected to the end section 70' of the reel band 70 (FIG. 6). Since the winding band 50 is held clamped in between the roll 54 and the rest element 58, the attachment of the end section 62' of the winding band 50 can be released without the roll 54 falling apart as a result.

The mount 10, together with the winding unit 54' deposited on the rest element 58, is then docked onto the stationary unwinding station 80 in the docking direction B. Of course, during this time, the deflection wheels 92 are initially located at a lower level than the rest surface 58' of the mount 10, with the result that the winding unit 54' can move over the wheels. The guide tracks 76 are then made to act on the guide rollers 104, as a result of which the rocker 78 is lifted into the rest position 106, which is shown by solid lines in FIGS. 3 and 7. In this arrangement, the roll 54 remains in abutment against the rest element 58 and the winding band 50 remains blocked.

In the event of docking, the follow-on member 122, furthermore, comes into engagement with the guide profile 82, as a result of which the lever 120 is pivoted downwards in the anticlockwise direction and the further deflection roller 116' is moved to beneath the reel drive wheel 118. In this arrangement, that section of the drive belt 110 which is located between the two deflection rollers 116 and 116' abuts against the reel drive wheel 118 by its outer side (FIG. 7).

The drive roller 112 is then connected to the drive motor 102, as a result of which that section of the winding band 50 and reel band 70 which is located between the rest element 58 and the band reel 68 is subjected to tensile stress. By providing the bellows 88 with compressed air, the rocker 78 is then lifted out of its rest position 106 into the operating position, which is indicated by chain-dotted lines in FIGS. 3 and 8, as a result of which the supporting belts 94 come to abut against the circumference of the roll 54 and raise the latter, together with the winding core 28 and the bearing arrangement 24, until the winding band 50 is no longer in contact with the rest element 58. The supporting belts 94 and conveying belts 98 are then also connected to the drive motor 102, as a result of which the winding unit 54', which is then driven circumferentially and is guided on the bearing arrangement 24, is made to rotate in the unwinding direction A. In this arrangement, the winding band 50 unwound from the roll 54 is retained constantly under tensile stressing and is wound up onto the band reel 68, the printed products which are unwound from the roll 54 together with the winding band 50 being transported away in the direction of the arrow A' on the supporting belts 94 and the conveying belts 98, FIG. 8.

As the roll 54 is unrolled on the supporting belts 94, the rocker 78 is retained in the operating position 106' and the bearing arrangement 24 is lowered, together with the winding core 28, corresponding to the reduction in diameter of the roll 54. As soon as all the printed products 52 have been unwound from the roll 54 and have been transported away from the unwinding station 80, the direction of rotation of the supporting belts 94 is reversed in order that the winding band 50 can be wound back from the band reel 68 onto the winding core 28, FIG. 9. As soon as the winding-band end 62' has passed the deflection roller 66, the supporting belts 94 are brought to a standstill, the bellows 88 are provided with air, as a result of which the winding core 28 with the winding band 50 comes to abut against the rest element 58 and the winding band 50 is blocked again, and the mount 10 is moved away from the unwinding station 80 counter to the docking direction B. The unwinding station is then ready for another mount 10 to be docked onto it. The end 62' of the winding band 50 may then be released from the reel band 70 and laid against the outermost winding of the winding band 50 wound up onto the winding core 28, it then being retained there, by a touch-and-close fastening strip.

The winding core 28 resting, with the winding band 50, on the rest element 58 is then raised by means of the handling device 126 until the bearing arrangement 24 is once again located in the latched receiving position 48' and the retaining roller 34 is once again located in the rest position 46', and said winding core is then removed from the bearing arrangement 24.

In the exemplary embodiment shown, the lifting means 95 for lifting the winding unit 54' lowered onto the rest element 58 are integrated in the rocker 78 for removing the unwound printed products 52. It is, of course, also conceivable to provide lifting means 95 which can act on the bearing arrangement 24 or on the winding core 28. These lifting means are preferably arranged on the unwinding station 80, which permits a very simple construction of the mounts 10. It is basically also conceivable, however, to provide lifting means 95, for lifting and lowering the bearing arrangement 24, on the mounts 10 themselves.

It is, of course, also possible to dispense with a reel band 70 and to connect the end 62 of the winding band 50 directly to the band reel 68 in each case. However, this means that the end section 62 of the winding band 50 has to be of a corresponding length.

In the embodiment shown, provision is made to mount the winding units 54' separately from the mounts 10 and to deposit them on the mounts 10 only for the unwinding operation. Of course, it is also conceivable to leave the empty winding core 28 on the bearing arrangement 24 and to leave the winding band 50, wound up onto the band reel 68, there. In this case, the winding band 50 may be connected fixedly to the band reel 68. The mount 10 may, in this case, be docked onto a winding-up station (not shown) where printed products are wound up onto the winding core 28 together with the winding band 50 subjected to tensile stressing.

In all the embodiments, it is, however, provided that the winding unit guided on the bearing arrangement 24 is deposited on the rest element 58 when the mount 10 is not docked on a winding station.

It is also possible to arrange the band reel in the winding station. It is also conceivable only to support the roll 54, in relation to the winding band 50, on one side by means of a supporting belt 94. Preferably, in this arrangement, the conveying belt 98 arranged on the other side is arranged to overlap the supporting belt 94, in order that the unwound printed products 52 can be conveyed away satisfactorily.

That which is claimed is:

1. A mount for rotatably supporting a winding unit which comprises a winding core, a winding band fastened at one end to said winding core under tensile stress, and printed products wound on said core between said core and said band to form a roll, said mount comprising a transportable framework having a bearing arrangement for rotatably mounting the winding core such that it can be rotated about a horizontal axis, and wherein the bearing arrangement is mounted for movement in an essentially vertical direction, and a rest element positioned beneath the bearing arrangement wherein the winding band rests on said rest element when the winding unit has been lowered onto the rest element to block the winding band.

2. A mount according to claim 1, wherein the rest element comprises a rest surface which, as measured in the direction of the horizontal axis, is at least as wide as the winding band.

3. A mount according to claim 1, wherein said framework comprises a rail guide which runs at least approximately in the vertical direction and on which a carriage of the bearing arrangement is mounted in a freely movable manner.

4. A mount according to claim 3, further comprising a latching device which acts, in a receiving position of the bearing arrangement, between the framework and the bearing arrangement and is configured to retain a non-loaded bearing arrangement in the receiving position and to release the bearing arrangement which is loaded with a winding unit.

5. A mount according to claim 1 wherein the bearing arrangement comprises a bearing member, on which the winding core is positioned, and a retaining member which, in a retaining position, prevents the winding core from being lifted from the bearing member, the retaining member being movable, when the bearing arrangement is located in a receiving position, into a rest position, wherein the winding core is released.

6. A mount according to claim 1, further comprising a band reel for receiving the winding band, said band reel being mounted rotatably on the framework.

7. A mount according to claim 6, further comprising a reel band which, at one end, is connected to the band reel and, at another end, is connected to a free end, remote from the winding core, of the winding band.

8. A mount according to claim 6, further comprising a winding station onto which the mount may be docked, said winding station including means for lifting the winding unit on the docked mount and a drive arrangement for rotating said band reel and wherein said mount further comprises track guide elements arranged on the framework for guiding the lifting means for the winding unit and the drive arrangement for the band reel when the mount is being docked onto the winding station.

9. An apparatus for processing printed products which are wound onto a winding core with a winding band which has one end fastened to the core, and so as to form a winding unit, said apparatus comprising a plurality of mounts, with each mount comprising a transportable framework, a bearing arrangement mounted on the framework for movement in an essentially vertical direction and for rotatably mounting the winding core of a winding unit for rotation about a horizontal axis, and a rest element mounted on the framework beneath the bearing arrangement and being positioned to engage the winding band when the winding unit has been lowered onto the rest element to block the winding band, and a winding station onto which each one of said mounts may be docked, said winding station comprising a stationary frame and a rocker pivotally mounted to said frame so as to be positioned below the winding unit of a docked mount, and lifting means for pivoting the rocker so as to lift the winding unit of the docked mount off from the rest element of the docked mount so that the printed products can be unwound.

10. The apparatus as defined in claim 9 further comprising an endless conveyor belt mounted to the winding station for transporting away the printed products as the winding unit is rotated in an unwinding direction.

11. The apparatus as defined in claim 10 wherein the rocker includes at least one endless supporting belt which is entrained about a plurality of deflection wheels, and wherein the lifting means acts to pivot the rocker between a rest position spaced below a winding unit on a docked mount and a lifted position wherein the winding unit is supported on the supporting belt.

12. The apparatus as defined in claim 11 wherein the one endless supporting belt is disposed laterally beside the winding band of a winding unit on a docked mount.

13. The apparatus as defined in claim 12 wherein the winding station further comprises a drive motor which is drivingly connected to the supporting belt for rotatably driving the winding unit on a docked mount.

14. The apparatus as defined in claim 11 wherein the winding station further comprises a drive motor which is drivingly connected to said conveyor belt and to said supporting belt.

15. The apparatus as defined in claim 11 wherein each of said mounts further comprises a band reel mounted to said framework, with said band reel being drivingly connected to a drive wheel, and wherein said winding station includes a drive arrangement for rotatably driving the drive wheel and thus the band reel of a winding unit on a docked mount, said drive arrangement including a drive motor, an endless drive belt coupled to the drive motor and being entrained about two spaced apart deflection rollers, with the deflection rollers being positioned so that the portion of the endless drive belt which runs between the deflection rollers operatively engages the drive wheel of the band reel.

16. The apparatus as defined in claim 15 wherein said drive arrangement further comprises a device for maintaining the endless drive belt in a taut condition.

17. The apparatus as defined in claim 15 wherein one of said deflection rollers is mounted on said rocker of said winding station, and the other deflection roller is mounted on a pivot lever which is pivotally mounted to the rocker, and further comprising follow-on guide means for guidingly positioning the rocker and the lever during docking of a mount with the winding station.

18. The apparatus as defined in claim 15 wherein said conveyor belt of said winding station is drivingly connected to said drive motor.

19. The apparatus as defined in claim 18 wherein said supporting belt is drivingly connected to said conveyor belt.

* * * * *